United States Patent [19]

Kasahara

[11] Patent Number: 4,980,253

[45] Date of Patent: Dec. 25, 1990

[54] ADDITIONAL INFORMATION RECORDING SYSTEM

[75] Inventor: Seitaro Kasahara, Hachioji, Japan

[73] Assignee: Konica Corporation, Tokyo, Japan

[21] Appl. No.: 441,352

[22] Filed: Nov. 21, 1989

Related U.S. Application Data

[63] Continuation of Ser. No. 223,892, Jul. 25, 1988, abandoned.

[30] Foreign Application Priority Data

Jul. 28, 1987 [JP] Japan ..... 62-188548
Jul. 28, 1987 [JP] Japan ..... 62-188549

[51] Int. Cl.[5] ..... G03G 13/22
[52] U.S. Cl. ..... 430/54; 430/47; 430/126; 355/244
[58] Field of Search ..... 430/47, 54, 126; 355/244

[56] References Cited

U.S. PATENT DOCUMENTS 4,035,073 7/1977 Del Vecchio ..... 430/126 X
4,045,218 8/1977 McVeigh ..... 355/7 X
4,477,176 10/1984 Russel ..... 430/126 X
4,803,520 2/1989 Tomosada et al. ..... 355/7

FOREIGN PATENT DOCUMENTS 60-242485 12/1985 Japan ..... 355/7
61-292668 12/1986 Japan ..... 355/244

*Primary Examiner*—Roland E. Martin
*Attorney, Agent, or Firm*—Jordan B. Bierman

[57] ABSTRACT

An object of the invention is to provide a copy machine for recording an additional information onto a copy of document without reducing the document original image. The copy machine has a display for indicating the additional information in the proximity of a glass platen for placing the document. The copy machine is adapted to perform copy operation at least two times so as to form both copy images of the document and the additional information on the same copy sheet.

10 Claims, 6 Drawing Sheets

| | | NUMBER OF UNITS | | | | | | | | | |
|---|---|---|---|---|---|---|---|---|---|---|---|
| | | 0 | 1 | 2 | 3 | 4 | 5 | 6 | 7 | 8 | 9 |
| NUMBER OF TENS | 0 | ア | カ | サ | タ | ナ | ハ | マ | ヤ | ラ | ワ |
| | 1 | イ | キ | シ | チ | ニ | ヒ | ミ | ゛ | リ | ， |
| | 2 | ウ | ク | ス | ツ | ヌ | フ | ム | ユ | ル | ン |
| | 3 | エ | ケ | セ | テ | ネ | ヘ | メ | ゜ | レ | 。 |
| | 4 | オ | コ | ソ | ト | ノ | ホ | モ | ヨ | ロ | ヲ |
| | 5 | ァ | ィ | ゥ | ェ | ォ | ッ | ゃ | ゅ | ょ | ー |
| | 6 | ， | ． | ； | ： | ／ | ＊ | ＋ | － | ＝ | ！ |
| | 7 | ＃ | ＄ | ％ | ＆ | ￥ | @ | ’ | ” | ＜ | ？ |
| | 8 | （ | ） | 「 | 」 | ＜ | ＞ | ［ | ］ | | |
| | 9 | 0 | 1 | 2 | 3 | 4 | 5 | 6 | 7 | 8 | 9 |

FIG. 6

| | | NUMBER OF UNITS | | | | | | | | | |
|---|---|---|---|---|---|---|---|---|---|---|---|
| | | 0 | 1 | 2 | 3 | 4 | 5 | 6 | 7 | 8 | 9 |
| NUMBER OF TENS | 0 | A | B | C | D | E | F | G | H | I | J |
| | 1 | K | L | M | N | O | P | Q | R | S | T |
| | 2 | U | V | W | X | Y | Z | | | | |
| | 3 | a | b | c | d | e | f | g | h | i | j |
| | 4 | k | l | m | n | o | p | q | r | s | t |
| | 5 | u | v | w | x | y | z | | | | |
| | 6 | , | . | ; | : | / | * | + | − | = | ! |
| | 7 | # | $ | % | & | ¥ | @ | ' | " | ^ | ? |
| | 8 | ( | ) | ⌜ | ⌟ | < | > | [ | ] | | |
| | 9 | 0 | 1 | 2 | 3 | 4 | 5 | 6 | 7 | 8 | 9 |

ADDITIONAL INFORMATION RECORDING SYSTEM

This application is a continuation of application Ser. No. 223,892, filed July 25, 1989 now abandoned.

The invention relates to an additional information recording system, in particular, to an additional information recording system whose overall operation consists of at least two cycles, i.e. recording of an original document and that of additional information.

In business corporations, it is a routine practice that a document is copied in a plurality of duplicates that are distributed to departments concerned. In this case, it is a common practice that duplicates are identified using a date of distribution, issuer, addressee, etc.

Besides these date, time, and issuer, mentioned above, the additional information on the duplicated sheets includes an ID number and destination. If a newspaper or magazine article is duplicated, an abstract or summary is usually added. In addition, if the document consists of a plurality of pages, pagenations should be incorporated.

It is extremely cumbersome to enter such various kinds of items on every original document. If the original document consists of a plurality of pages, it may happen that incorrect information is filled onto these sheets.

Conventional device for solving such problems include a printer that prints characters on the duplicated image; or a liquid crystal indicator disposed on the platen glass or document carrying member, thereby what is displayed on this liquid crystal indicator is incorporated into the duplicate image. However, a device useing a printer results in a bulky copying apparatus. If a liquid crystal indicator is disposed on a platen glass or document carrying member, it is necessary to provide additional keys for entering data to be displayed on the liquid crystal indicator. If additional information is to be displayed, it is sometimes necessary to reduce the document to allow a blank on recording sheets in order to accommodate additional information, thus resulting in a disadvantageously expensive copying apparatus.

SUMMARY OF THE INVENTION

The present invention is intended to be a solution to the above-mentioned problems of a conventional additional information recording system. Therefore, it is an object of the invention to provide an additional information recording system that is capable of recording additional information without reducing an original document, wherein an operating section of the recording system also serves as an additional information input section, and the system is capable of forming a blank on each recording sheet in order to allow additional information to be recorded.

To solve the above-mentioned problems, the invention provides an apparatus that is arranged as follows in the additional information recording system which records additional information such as date, etc., the apparatus is provided with an additional information indication section in the lower part of the scale plate; an copying operation consists of at least two cycles, in the first cycle, a duplicate image corresponding with the image on the original document other than the area corresponding with an additional information-forming portion is formed; in the second cycle, a duplicate image of the contents on the indication section is duplicated in the area, which corresponds with the additional information-forming portion, on the duplicate image formed in the first cycle.

By using the above apparatus, the invention allows additional information to be produced on a part of the duplicate image. Thus, the invention greatly expedites filing of duplicated documents because each of the duplicated documents bear not only the contents of the original documents but also other necessary information.

In another preferred embodiment, the object mentioned above can be achieved using means wherein with the above-mentioned additional information recording system, the image of an original document is copied on a copying sheet in one cycle, and, in the other cycle, the contents on the additional information indication section are copied on the same sheet.

In this preferred embodiment, according to the above-mentioned means, a copying sequence for an original document image is independent of a copying sequence for the contents of the additional information indication section. Thus, a duplicate image formed has these two types of information, and, accordingly, facilitates document filing.

BRIEF DESCRIPTION OF THE DRAWINGS

FIG. 6 is a table of alphanumerical characters and symbols.

DETAILED DESCRIPTION OF THE INVENTION

Figure 1:
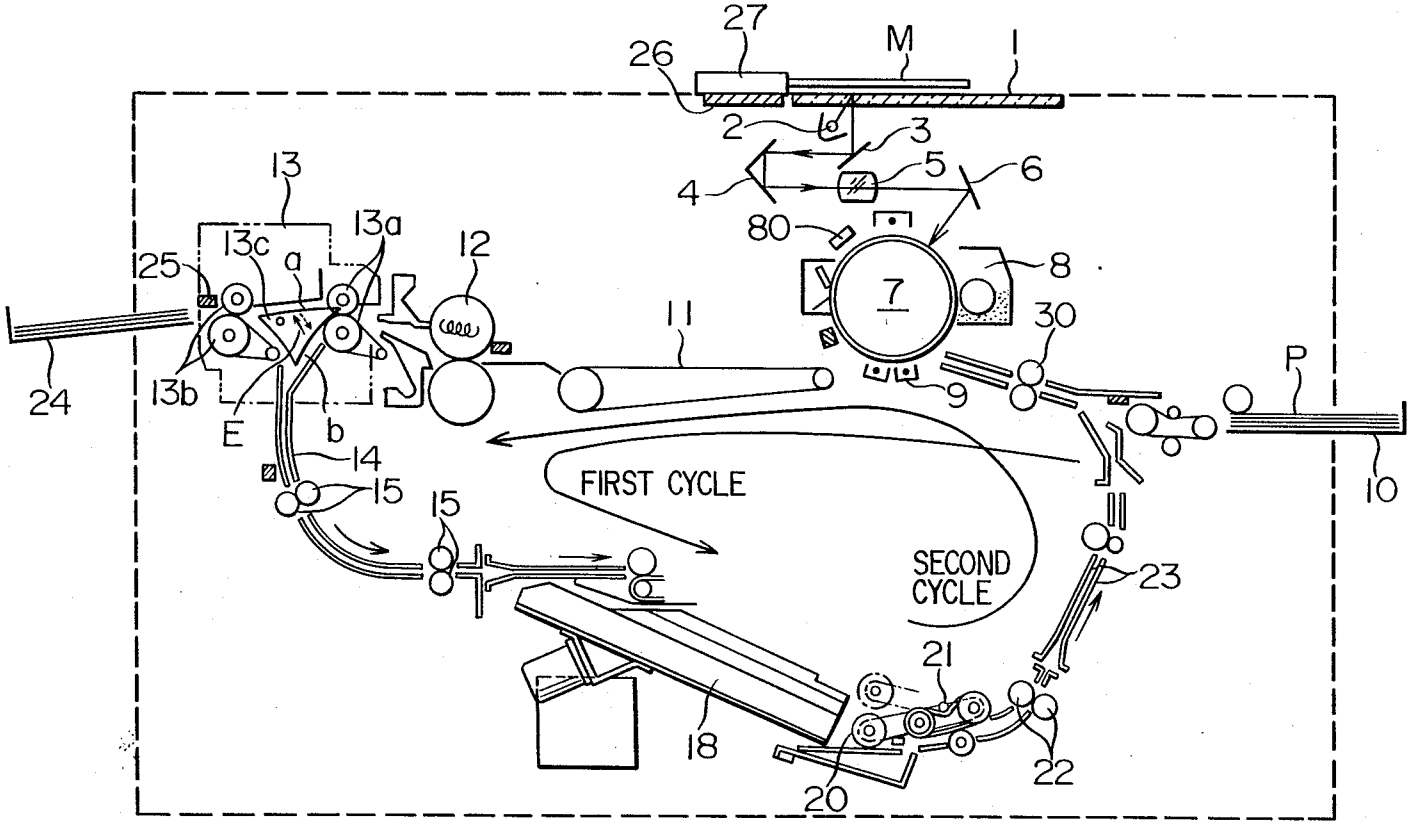
FIG. 1 is a schematic drawing of the additional information recording system according to the invention.

The embodiment of the invention shown in the drawings are hereunder described.

FIG. 1 schematically shows the additional information recording system according to the invention.

A copying operation without involving additional information is as follows: When a number of copy sheets is entered with a copy set number setting button, and then, a copy button are pressed, the first sheet of the one-sided document M on a document table (platen) 1 is exposed with an illuminating lamp 2, thereby light reflected from the document M is directed to a photoreceptor drum 7 via a movable mirrors 3, 4, lens 5, and fixed mirror 6, thus forming an electrostatic latent image.

The electrostatic latent image is developed by a developing unit 8, the toner image is transferred by a transferring unit 9 onto a copying sheet P which has been fed from a sheet feeding cassette 10, and then, transported by a conveyance belt 11 to a fixing unit 12 that fixes the toner image.

Somewhat prior to fixing, a deflector mechanism 13, by unshown switching means such as a solenoid, is shifted pivotally on the point E in the solid arrow direction; a copying sheet undergone one-side copying is directed to a guide plate 14 by guide rollers 13*a* through a turning passage b, then further transported by guide rollers 15, and temporarily stored in an intermediate tray 18.

Likewise, the first sheet of the original document is copied on the other copying sheets, and these sheets are stored in the intermediate tray 18.

Next, once the second sheet of the original document is placed on the document table (platen) 1 and the copy button is pressed, a series of electrophotographic processing steps are performed with the second sheet of this one-sided document.

More specifically, the sheet of the original document is exposed with an optical scanning system, thereby an electrostatic latent image is formed on the photoreceptor drum 7, and is developed by the developing unit 8.

At the same time, copying sheets once undergone copying and hitherto stored in the intermediate tray 18 are fed from the top one onwards by a feed roller 20, at timing that is synchronous with that of the above electrophotographic processing, thereby the sheets are transported on a paper feed belt 21.

The copying sheets undergone one-side copying are transported to the transferring position along the guide plate by guide rollers 22, where the toner image, on the photoreceptor drum 7, of the second sheet of the original one-sided document is transferred onto the copy sheets.

The copying sheets thus respectively undergone copying on the other face are transported to the fixing unit 12 via the conveyance belt 11, thereby the sheets are subjected to fixing with the fixing unit 12.

At this moment, a deflector plate 13*c* of the deflector mechanism 13 has been already shifted to the direction shown by the arrow of broken line, and, correspondingly, the copy sheets transported by the guide rollers 13*a* and *b* pass through a paper discharge passage a, and are discharged from a paper outlet of the copying apparatus, and are stored in a paper discharge tray 24.

At this time, a paper discharge sensor 25 detects discharging of duplicated sheets.

On the upper left portion of the document table (table) 1 of the so-constituted additional information recording system is disposed a scale plate 27; a liquid crystal indication section 26 is provided between the scale plate 27 and the document table (platen) 1.

Figure 2:
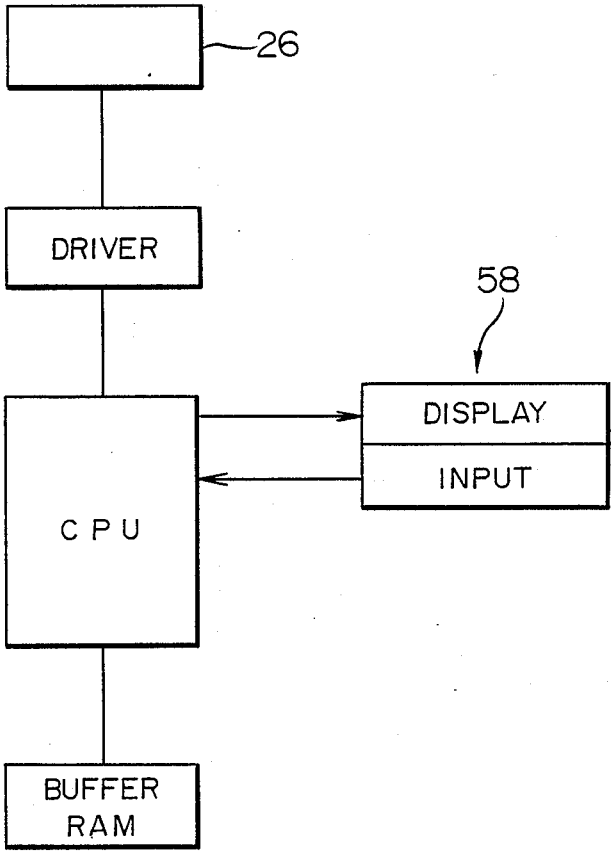
FIG. 2 is a block diagram showing a control circuit.

The liquid crystal indication section 26 is, as shown in FIG. 2, connected to a central processing unit (CPU). To the central procession unit (CPU) are connected an operation panel 58 of the electrophotographic copying apparatus, using which duplicating conditions are entered or indication is displayed on the liquid crystal indication section 26.

When forming a duplicate image by using the so-constituted electrophotographic copying apparatus, an original document M is first placed on the document table (platen) 1.

Then the position of the original document are correctly adjusted by aligning its edges with the scale plate 27. Next, a platen cover (unshown) is placed over the document, and necessary data are entered with the operation panel 58.

Figure 3:
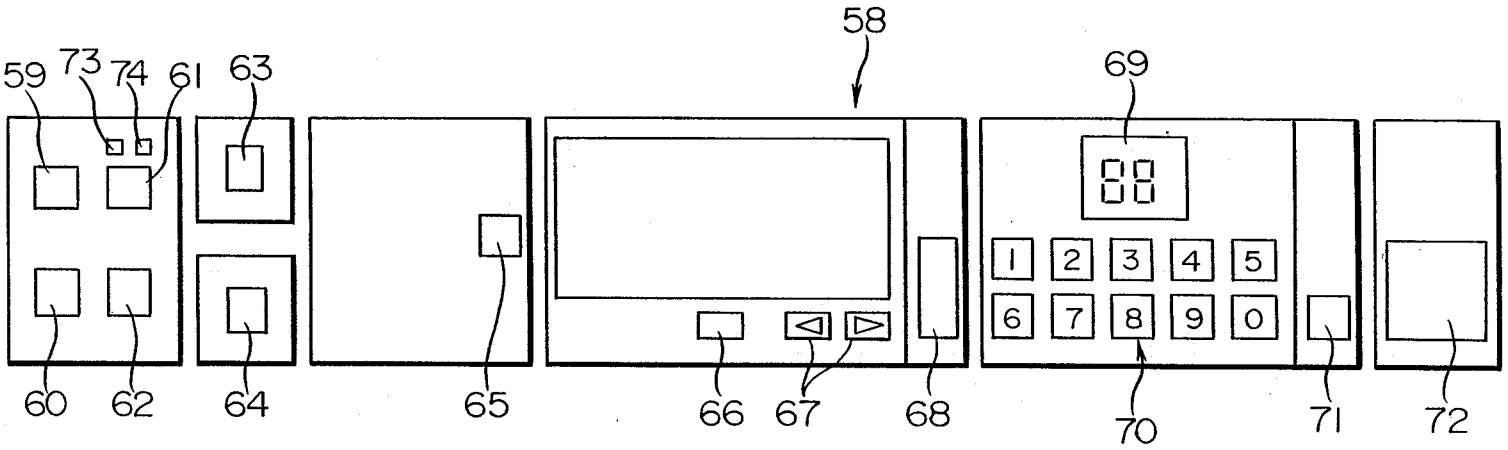
FIG. 3 shows an operation panel.

The operation panel 58 has a configuration in FIG. 3. When a number of sheets to be copied is entered with ten keys 70, the number appears on a copy number indicating LED 69.

Numeral 68 represents an AUTO mode key. Keeping this key being pressed actuates an EE mechanism that detects the size of the original document and automatically determines which size of copying sheets to be fed, thereby the mechanism determines the relevant copying density. A cassette selection key 66 and density setting key 67 are also provided to manually set the copying sheet size and density.

Numeral 65 represents a variable magnification setting key for changing the size of the duplicate image; 64, a sorter selection key; 63, an operation key of the automatic document feeding mechanism; 72, a copy start key; and 71, a stop clear key.

Other keys provided on the operation panel 58 are a character input key 59, set key 60, mode selection key 61, and print key 62.

The procedure for incorporating additional information into a duplicate image using the additional information recording system that works as described above are as follows:

When the print key 62, among the keys on the operation panel 58, is pressed, the central processing unit (CPU) is ready to incorporate additional information into a duplicate image, that is, the indication section 26 is ready to operate.

Once the print key 62 on the operation panel 58 is turned ON, additional information is entered with the keys on the operation panel 58 to display the information on the indication section 26.

Characters can be entered either in "Katakana" (Japanese alphabet) mode or alphanumerical mode. A mode selection key 61 is used to select KATAKANA mode or alphanumerical mode.

According to this embodiment, two pilot lamps 73 and 74 are disposed above the mode selection key 61. In KATAKANA mode, one lamp glows. When the mode selection key 61 is pressed again, the mode changes from KATAKANA mode to alphanumerical mode; the lamp goes off, and the other lamp glows. These pilot lamps 73 and 74 indicate the currently effective mode.

Figures 4, 5:
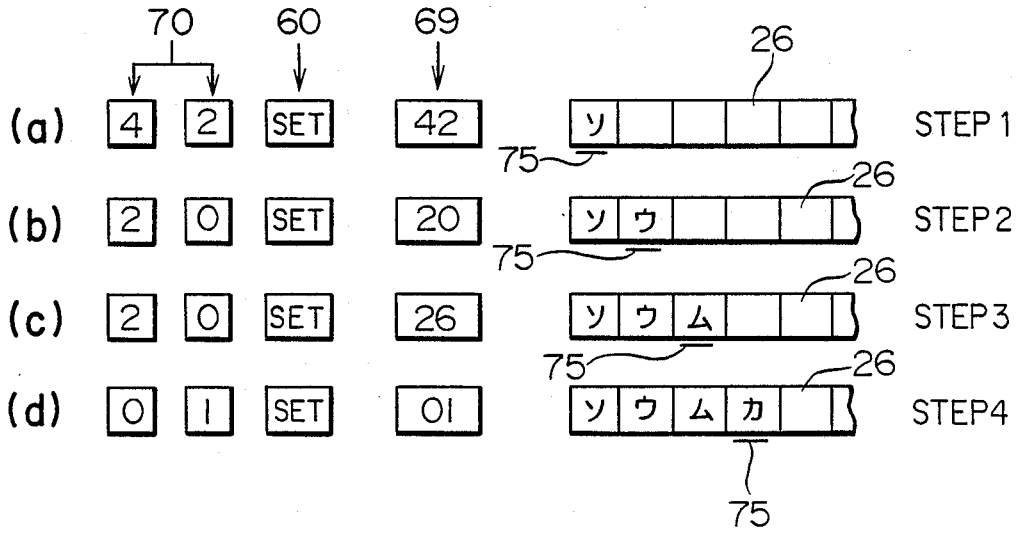
FIG. 4 is a table of KATAKANA (a Japanese alphabet system codes).
FIGS. 5(*a*), (*b*), (*c*), and (*d*) show entry statuses, and corresponding cursor positions.

The procedure to enter data in the KATAKANA mode are as follows:

First, characters are selected with ten keys 70 according to the addresses in the code table shown of FIG. 4. When "4", next, "2" are entered with the ten keys, "4", then "2" appear on the copy number indication LED, and then, pressing the set key enters the character of the address "42", i.e. "ﾝ" appears on the copy number indication LED (FIG. 5(*a*); likewise, pressing "2", "0", and the set key enters "ﾀﾞ" (FIG. 5(*b*)); pressing "2", "6", and the set key enters "ﾑ" (FIG. 5(*c*)); pressing "0", "1", and the set key enters "ｶﾞ" (FIG. 5(*d*)). Thus, a series of characters "ﾝ" "ﾀﾞ" "ﾑ" "ｶﾞ" are displayed on the indication section.

Until the set key 60 is pressed, the cursor 75 is located in the lower line on the indication section 26, and a character which is entered using ten keys appears above the cursor. The stop clear key 71 is pressed in order to delete a character above the cursor 75.

The cursor 75 moves one character position right, when two numerals are entered to designate and address and then pressing the set key 60. When providing a blank on the indication section 26, either of the density setting keys 67 is pressed to move the cursor 75 in either directions indicated by an arrow on the face of each density setting key 67.

The mode can be switched from KATAKANA mode to alphanumerical mode by pressing the mode selection key 61, and the pilot lamp glowing is also changed from one to the other.

Alphanumerical characters can be likewise entered referring to the addresses in the code table of FIG. 6.

Numerals and symbols are assigned to the addresses common to KATAKANA mode or alphanumerical mode in order to facilitate the operation.

In the above embodiment, the character input key 59 is pressed for entering characters. However, it is also possible to ensure the similar function by simultaneously keeping "4" and "7", on ten keys, pressed, and at the same time, by pressing the stop clear key 71. Simultaneously pressing a plurality of keys returns the current mode to an ordinary copy mode. Moreover, a priority can be given either to KATAKANA mode or alphabet mode depending on the ON or OFF status of a dip switch (provided on a printed circuit board). For example, if the dip switch is in a the ON position, the KATAKANA mode is given a priority.

It is accordingly possible, with the dip switch in the ON position, to unconditionally start the KATAKANA mode when the character input key 59 is pressed.

It is also possible to unconditionally start the additional information print mode by setting the dip switch to the ON position, and this arrangement can eliminate the print key 62. Thus, setting the dip switch to the ON position always starts the additional information print mode, thereby omission of date or addresser can be prevented.

Additionally, the cassette selection key 66 may also serve as the mode selection key 61; and a copy start key may serve as the set key 60.

Thus, a duplicate image with intended additional information can be obtained by entering the contents with the indication section 26, and by pressing the copy start key 72 to actuate the additional information recording system. When recording the additional information, the operation of the electrophotographic copying apparatus is constituted by two cycles, i.e. one cycle for recording the image of the original document and the other for recording the contents of the additional information.

A neutralizing lamp 80 comprising an LED that neutralizes an electric charge on an electrostatic latent image formed on the surface of the photoreceptor drum 7 is disposed in the vicinity of the photoreceptor drum 7 of the electrophotographic copying apparatus. This lamp has a length corresponding with the span of the photoreceptor drum 7, and the lamp is capable of illuminating only an intended part of the photoreceptor 7.

Figure 7:
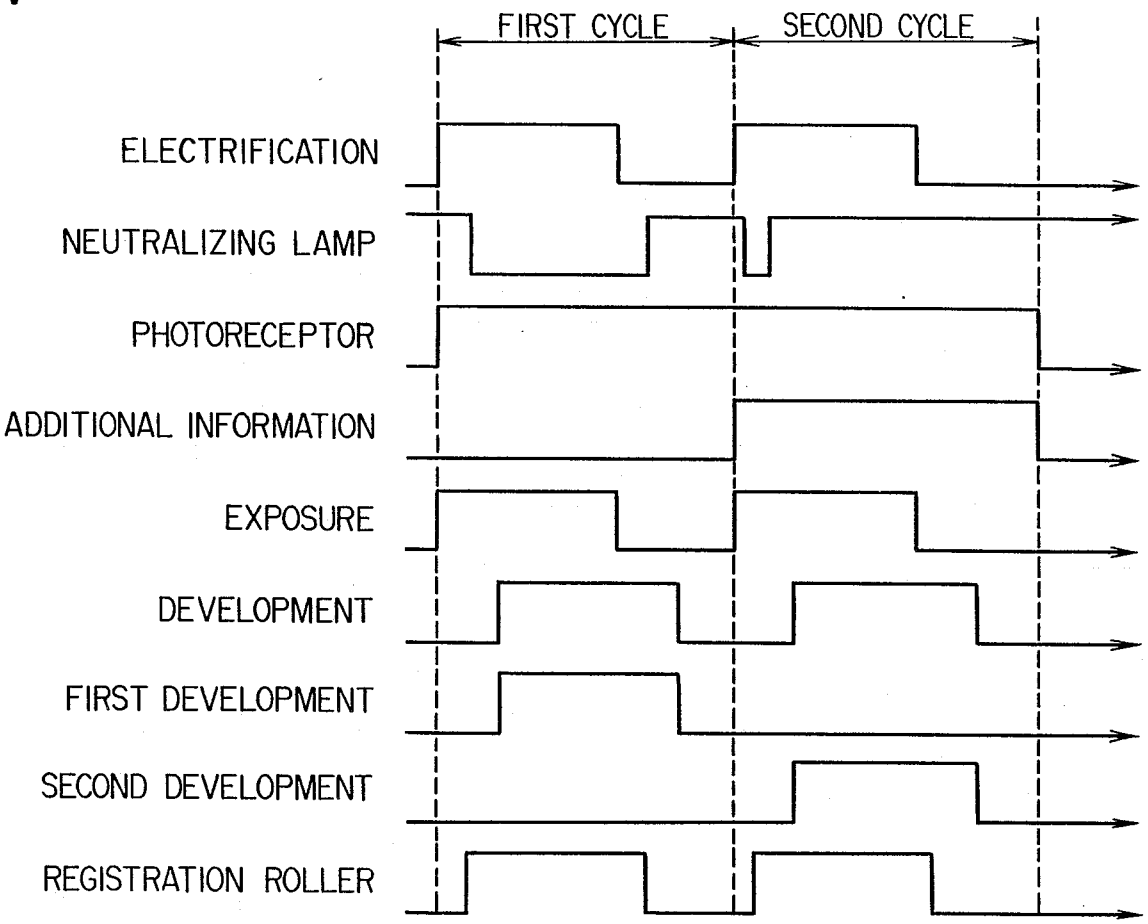
FIG. 7 shows operating timing of the respective members.

As shown in FIG. 7, the correlation between lighting timing of the above neutralizing lamp and duplicating operation of the electrophotographic copying apparatus is as follows: In the first cycle, the circumferential surface of the photoreceptor drum 7 is electrified, and an electrostatic latent image of the original document is formed by an exposing means.

In the case where additional information is displayed, only a portion, of the neutralizing lamp, that corresponds with the additional information indication section 26 glows to neutralize the electric charge of the specific portion (of the latent image) that corresponds with the area to be formed the additional information indicated by the additional information indication section 26; next, the photoreceptor drum rotates and the latent image reaches the developing unit 8, thereby a part, other than the portion subjected to the neutralizing lamp, is developed; then a toner image is formed on the circumferential surface of the photoreceptor drum, wherein this image does not include the portion corresponding with the area to be formed the additional information of the additional information indication section 26; the toner image is transferred onto a copying sheet P and fixed by the fixing unit 12; and the copying sheet is, by the deflector mechanism 13, directed to the intermediate tray 18 and temporarily stored therein, waiting for further processing.

In the second cycle, the circumferential surface of the photoreceptor drum 7 is electrified again. In this occasion, a portion of the neutralizing lamp that corresponds with the other portion than that corresponds with the indication section 26 glows. Accordingly, the electrified portion on the photoreceptor drum 7 reaches the exposure section, wherein this electrifeed portion alone corresponds with the area to be formed the additional information of the additional information indication section 26 and where no image has been formed in the first cycle, thereby the contents on the indication section 26, that is, the additional information, is formed on the photoreceptor drum 7 as an electrostatic latent image. This image is developed by the developing unit 8 to form a toner image. The toner image is transferred onto the copying sheet P which has stored in the intermediate tray 18, processed by the transferring unit 9 and the fixing unit 12, whereby a duplicate image comprising a original document image that has incorporated additional information. In this case, in order to registrate the toner image of the additional information with the position of the predetermined area to be formed the additional information on the copy sheet, as shown in FIG. 7, in the second cycle the start timing of registration roller 30 for feeding the copy sheet onto the photoreceptor is made faster than that in the first cycle, thereby superposing the toner image of the additional information onto the copy sheet.

If a developing unit for the first cycle is independent of that for the second cycle, it is possible to obtain a duplicate image in which the color for an original document differs from that of additional information. FIG. 7 shows timing charts of the respective units, wherein the last two sections show the case where two developing units are provided.

The second embodiment is hereunder described. In the first cycle, the circumferential surface of the photoreceptor drum 7 is electrified by an electrifying unit, and an electrostatic latent image corresponding with an original document is formed by the exposure means.

At this first cycle, the newtralizing lamp does not glow and additional information is not indicated. Accordingly, a toner image of the original document alone is formed. This toner image is transferred on a copying sheet P, and fixed by the fixing unit 13. The sheet is temporarily transported to and stored in the intermediate tray 18 via the deflector mechanism 13, and the sheet waits for further processing.

In the second cycle, the circumferential surface of the photoreceptor drum 7 is electrified again. In this second cycle, the newtralizing lamp glows the area other than the area to be formed additional information and the indication section 26 indicates additional information. Accordingly, an electrostatic latent image of this additional information is formed on the photoreceptor drum 7, thereby the latent image is developed by the developing unit 8 to form a toner image. The toner image is transferred, by the transferring unit 9, onto a copying sheet P that has been stored in the intermediate tray 18, thereby the copying sheet P is processed by the separating unit, and the fixing unit 19, thus a duplicate image comprising original document image that has incorporated additional information.

As described above, according to the invention, a copying operation consists of two cycles of duplication processes, wherein in one cycle, the document information other than the additional information is duplicated, wherein in the other cycle, the additional information is duplicated, and the two images are integrated together. Resultingly, the recording sheet undergone copying bears these two types of images, ie.e. an original document image and the contents of additional information. Accordingly, the invention provides excellent effects; for example, the nature of the original document is clearly indicated, greatly facilitating filing work.

Incidentally, in the above embodiments, the original document image is formed at the first cycle. However, of course, it is possible to form the additional information image at the first cycle and then form the document image at the second cycle.

What is claimed is:

1. A method of recording a first image from a first original and a second image from a second original onto an image receiver, said second original being adjacent and outside said first original in a direction parallel to a scanning direction thereof, said method comprising a first copy cycle which comprises (1) a first scanning of said first original in said scanning direction, (2) imagewise exposure of a charged surface of a photoreceptor to radiation reflected from said first original to form a first latent image on said surface, (3) development of said first latent image to form a first toner image, (4) bringing a leading edge of said image receiver to a transfer zone at a first time when a leading edge of said first toner image is at said transfer zone, (5) transferring said first toner image to said image receiver at said transfer zone, said method further comprising a second copy cycle which comprises (6) a second scanning of said second original, (7) imagewise exposure of said charged surface to radiation reflected from said second original to form a second latent image, (8) development of said second latent image to form a second toner image, (9) bringing said leading edge of said image receiver to said transfer zone at a second time when a leading portion of said second toner image is also at said transfer zone,

(10) transferring said second toner image to said leading edge of said image receiver, whereby said second image is positioned adjacent said leading edge of said image receiver.

2. The method of claim 1 wherein said first scanning includes scanning at least a portion of said second original.

3. The method of claim 1 wherein said second scanning includes a scanning at least a portion of said first original, said method further comprising neutralization of a part of said second latent image corresponding to said portion.

4. The method of claim 1 wherein said first scanning includes scanning at least a section of said second original, said method further comprising neutralization of part of said first latent image corresponding to said section.

5. The method of claim 1 wherein said leading edge of said image receiver is brought to said transfer zone at said second time by adjusting the time of feeding said image receiver.

6. The method of claim 1 wherein said leading edge of said image receiver is brought to said transfer zone at said second time by adjusting the timing of said second scanning.

7. The method of claim 1 wherein said first original is placed on a glass platen.

8. The method of claim 7 wherein said second original is a display member disposed adjacent the glass platen.

9. The method of claim 8 wherein said display member is a liquid crystal display.

10. The method of claim 1 wherein said first scanning includes scanning at least a section of said second original, said method further comprising neutralization of part of said first latent image corresponding to said section, said second scanning including scanning at least a portion of said first original, said method further comprising neutralization of a part of said second latent image corresponding to said portion.

* * * * *